United States Patent [19]

Yano et al.

[11] 4,167,322

[45] Sep. 11, 1979

[54] ELECTROSTATIC COPYING SYSTEM HAVING MONITORING DEVICES

[75] Inventors: Takashi Yano; Tatsuo Tani; Nachio Seko; Hiroyuki Idenawa; Isao Nakamura, all of Tokyo, Japan

[73] Assignee: Ricoh Company, Ltd., Tokyo, Japan

[21] Appl. No.: 929,273

[22] Filed: Jul. 31, 1978

[30] Foreign Application Priority Data

Aug. 11, 1977 [JP] Japan ..... 52-96321
Aug. 12, 1977 [JP] Japan ..... 52-96103

[51] Int. Cl.[2] ..... G03G 15/00

[52] U.S. Cl. ..... 355/3 R; 340/524; 355/14

[58] Field of Search ..... 355/3 R, 14, 11, 133; 340/524, 525, 286 M

[56] References Cited

U.S. PATENT DOCUMENTS

| | | | |
|---|---|---|---|
| 3,427,441 | 2/1969 | Swords | 355/14 X |
| 3,597,071 | 7/1971 | Jones | 355/3 R |
| 3,624,648 | 11/1971 | Willoughby | 340/286 M X |
| 3,936,180 | 2/1976 | Willard et al. | 355/3 R X |
| 4,074,242 | 2/1978 | Mayer | 340/524 X |

*Primary Examiner*—R. L. Moses
*Attorney, Agent, or Firm*—David G. Alexander

[57] ABSTRACT

A plurality of electrostatic copying machines (12), (13), (14), (16) are interconnected by bus lines (19), (21), (22). Each copying machine (12), (13), (14), (16) is provided with a sensor unit (23) for sensing various status parameters of the copying machine (12), (13), (14), (16) such as whether the copying machine (12), (13), (14), (16) is available for use, the copy sheet size, the number of copies made, the number of copy sheets remaining, etc. Each copying machine (12), (13), (14), (16) is further provided with a display unit (17) for displaying the status parameters of all of the copying machines (12), (13), (14), (16). A microcomputer (31) is provided at one of the copying machines (12) for storing and processing the status parameters and producing a hard copy.

10 Claims, 4 Drawing Figures

ELECTROSTATIC COPYING SYSTEM HAVING MONITORING DEVICES

BACKGROUND OF THE INVENTION

The present invention relates to an electrostatic copying apparatus comprising a plurality of interconnected copying machines.

In large business and government organizations it is necessary to provide an electrostatic copying facility which can produce various types of copies at high speed. One approach to the problem is to provide a single high speed copying machine which can achieve all functions such as copying on various sizes of copy paper at various magnification ratios. This approach has two serious drawbacks, one being the extremely high cost of such a copying machine and the second being the fact that only one person can make copies at any given time.

A second approach is to provide several copying machines which are constructed to enable different functions such as copying on different sizes of copy paper. The copying machines are preferably located at different places in an office building for employee convenience. Generally, several single function copying machines may be purchased at a lower total cost than a single all-function copying machine.

Although the second approach overcomes the disadvantages of the first approach, it introduces other problems. For example, a person at one location has no way of knowing which copying machines are in use or broken. Also, more work is required in supplying different sizes of copy paper, toner etc. for the several copying machines. It is also more difficult, where an organization has a number of sections, to determine how many copies are made by each section and of what size for cost allocation purposes.

SUMMARY OF THE INVENTION

An electrostatic copying apparatus embodying the present invention includes a plurality of electrostatic copying machines. A plurality of sensor means are connected to the copying machines respectively for sensing at least one copying machine status parameter. Display means are connected to the copying machines respectively. Interconnection means interconnect all of the sensor means and display means in such a manner that each display means displays the status parameters of all of the copying machines.

It is an object of the present invention to provide an electrostatic copying apparatus comprising a plurality of electrostatic copying machines and means by which a user at one copying machine can determine the status of all of the copying machines.

It is another object of the present invention to provide an electrostatic copying apparatus comprising a plurality of electrostatic copying machines and means for automatically collecting data indicating the status of all of the copying machines.

It is another object of the present invention to provide a generally improved electrostatic copying apparatus.

Other objects, together with the foregoing, are attained in the embodiments described in the following description and illustrated in the accompanying drawing.

DESCRIPTION OF THE PREFERRED EMBODIMENTS

While the electrostatic copying apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
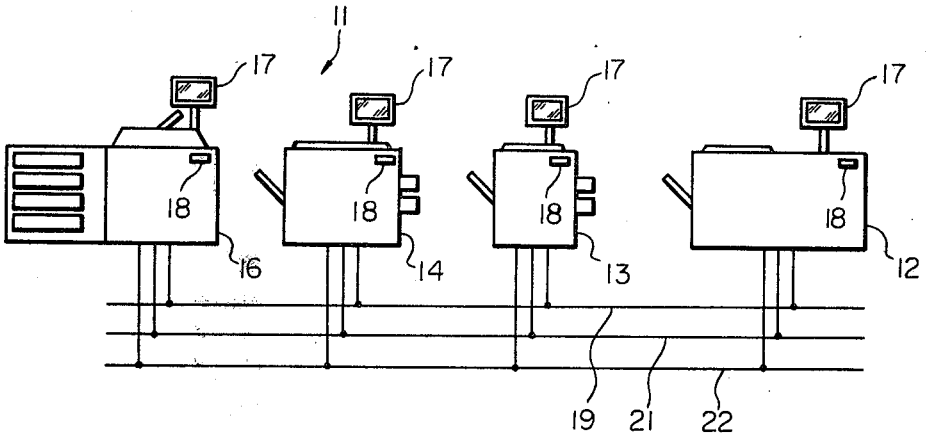
FIG. 1 is a schematic view of an electrostatic copying apparatus embodying the present invention.

Referring now to FIG. 1 of the drawing, an electrostatic copying apparatus embodying the present invention is generaly designated by the reference numeral 11 and comprises electrostatic copying machines 12, 13, 14 and 16. Each of the copying machines 12, 13, 14 and 16 comprises a display unit 17 and a code input unit 18. The copying machines 12, 13, 14 and 16 are preferably provided at different locations in an office building (not shown) and are interconnected by an address bus or bus line 19, a data bus line 21 and a control bus line 22.

Typically, the copying machine 12 is a high speed unit capable of copying on B4 size paper. The copying machine 13 is a normal speed unit capable of copying on B4 size sheets. The copying machine 14 is capable of copying on A3 size paper at reduced magnification. The copying machine 16 is provided with an automatic feed mechanism for original documents and capable of aligning the images on copy sheets.

The display units 17 are capable of displaying various copying machine status parameters of all of the copying machines 12, 13, 14 and 16. In other words, a copying machine operator or user may determine the status of all of the copying machines 12, 13, 14 and 16 merely by observing the display unit 17 at any one of the copying machines 12, 13, 14 and 16.

The status parameters may be divided into two general types. The first type includes parameters which are of interest to a copying machine user, such as:

1. Whether a particular copying machine is available for use or whether it is unavailable because it is being used by another user, broken, etc.
2. The size of the copy sheets used in each copying machine.

The second type of parameter is of interest to maintenance or accounting personal who service the apparatus 11. These include:

3. The number of copies made by a certain copying machine, and the person or section who made the copies.
4. The number of copy sheets remaining in each copying machine and/or supply cabinet.
5. The amount of toner remaining in each copying machine and/or supply cabinet.
6. The amount of deterioration of the photoconductive element of each copying machine.

Figure 2:
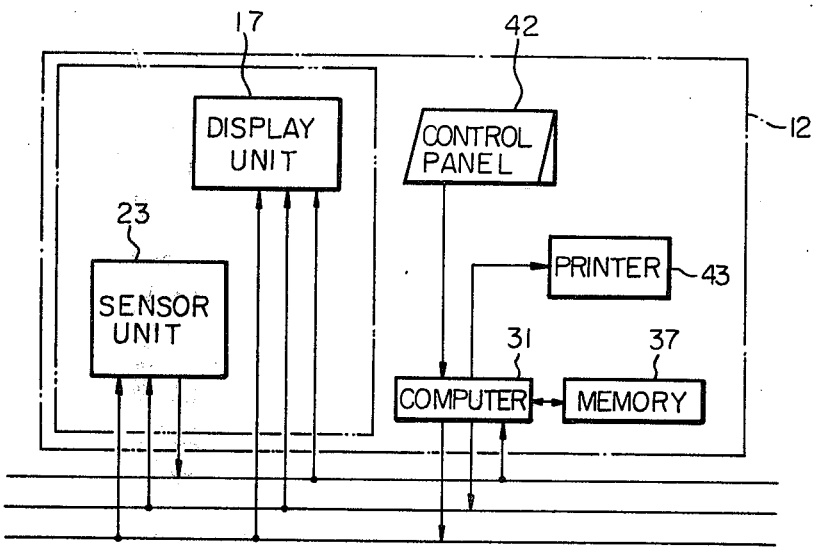
FIG. 2 is a block diagram of various units provided at one of the copying machines of the apparatus.
Figure 3:
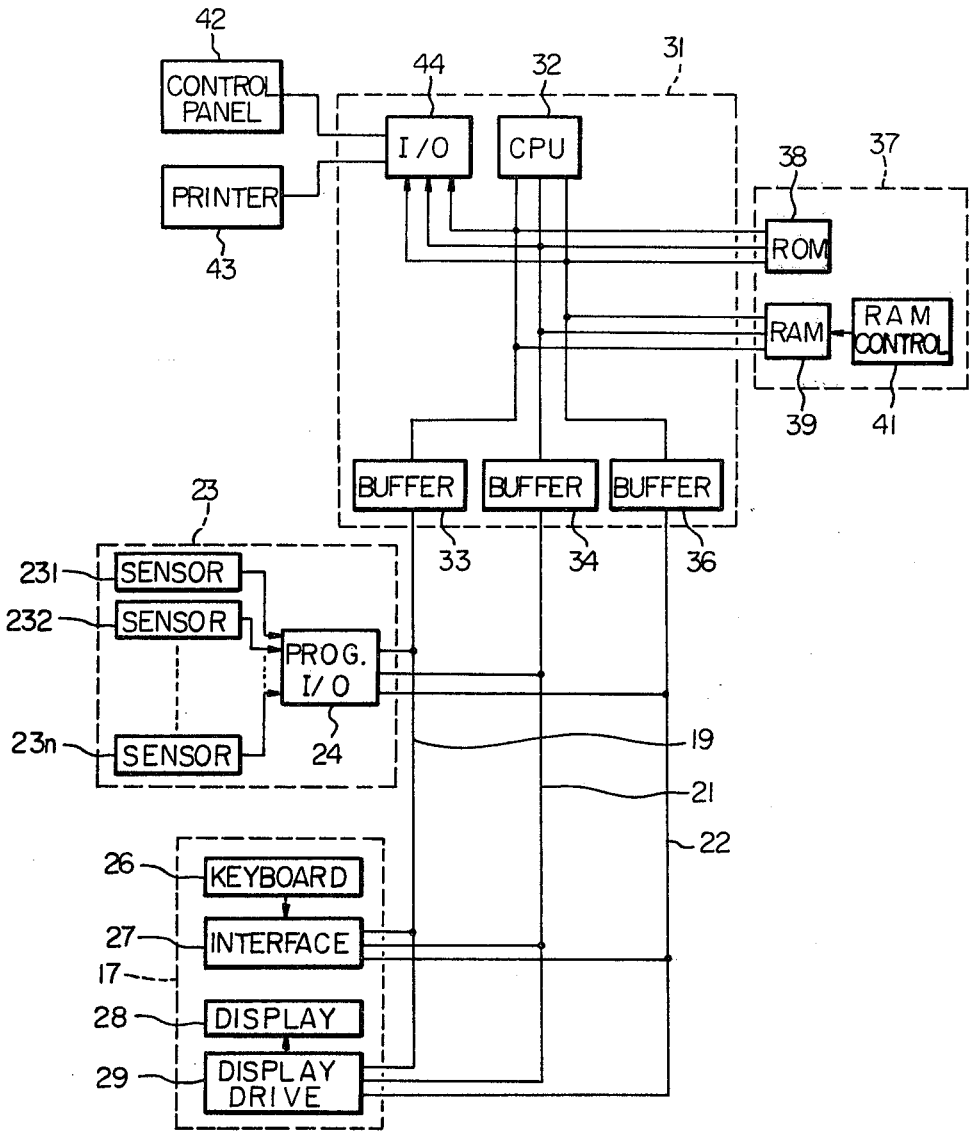
FIG. 3 is a more detailed block diagram of the units shown in FIG. 2.
Figure 4:
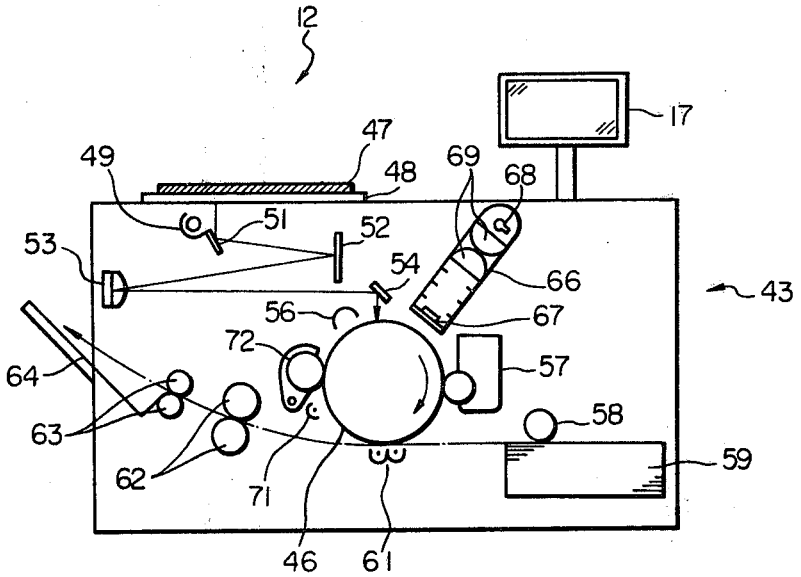
FIG. 4 is a schematic side view of said one of the copying machines illustrating a novel printing means.

With reference also being made to FIGS. 2 to 4, each of the copying machines 12, 13, 14 and 16 comprises a sensor unit 23 including a plurality of various sensors 231, 232 . . . 23*n* for sensing n parameters. These sensors 231, 232 . . . 23*n* are connected to the bus lines 19, 21 and 22 through a programmable input-output interface (I/O) 24.

The sensors for sensing parameter number (1) above function to, for example, sense the status of a main switch which is maintained in a certain position only during copying (busy indication). Other sensors may sense the position of a keep relay which is energized in response to a jam condition and remains energized even though a main power switch is opened (jam condition). Other sensors may sense the position of an alarm switch which a user presses when the copying machine malfunctions in some way, runs out of paper or toner, etc. (inoperative condition).

Sensors for sensing parameter number (2) above may be embodied by microswitching provided to a cassette holder of a copying machine at different positions. Copy sheet cassettes of different sizes are in this example provided with lugs at different positions to engage and actuate only one of the microswitches corresponding to the paper size.

Parameter number (3) above may be sensed by means of the code input unit 18 and a copy counter. Each copy machine user or section is provided with a numeric code indicating his identity. Where a user wishes to make copies he inputs his code number into the particular copying machine by means of the code input unit 18. Preferably, the copy machine may not be operated unless it is verified that the code number is valid and that the user is authorized to use the copying machine. The code input unit 18 may be embodied by any means known in the art such as a keyboard, magnetic card reader, etc. In the latter case, each user is provided with a magnetic card for insertion into the code input device 18 on which his code number is magnetically imprinted.

Parameter number (4) above may be sensed by means of the copy counter which counts the number of copies made after a full cassette is inserted into the copying machine. The number of remaining sheets is equal to the number of sheets in a full cassette minus the number of copies made. Where a supply cabinet is provided with individual compartments for storing individual boxes of copy paper, microswitches may be provided to the compartments to sense for the presence or absence of each box of copy sheets.

Parameter number (5) may be sensed by means of any device capable of measuring the amount of toner in a hopper in the particular copying machine. Alternatively, sensor means may be provided to measure the amount of toner which has flowed through a passageway leading from the hopper to a developing unit of the copying machine since the hopper was filled. Where individual compartments are provided for toner bottles or boxes in a supply cabinet, microswitches may be provided to sense for the presence or absence of the toner bottles.

The amount of deterioration of a photoconductive member such as a drum, parameter number (6), may be determined by counting the number of copies made since a new drum was installed in the copying machine.

Each display unit 17 comprises a keyboard 26 connected to the bus lines 19, 21 and 22 through an interface 27 and a display 28 which is connected to the bus lines 19, 21 and 22 through a display drive unit 29. The display 28 may be embodied by a cathode ray tube (CRT) device capable of displaying one or more lines of data, a light emitting diode (LED) display device capable of displaying characters in 7-segment or dot matrix configuration, an incandescent light display (indicator lamps), etc.

Although it is within the scope of the present invention for the display 28 of any of the copying machines 12, 13, 14 and 16 to display all of the parameters of all of the copying machines 12, 13, 14 and 16 simultaneously, it is preferable from the viewpoint of reducing the size and cost of the display 28 to selectively view only certain parameters or even only one parameter at one time. For example, the user might wish to display parameter (1) for all of the copying machines 12, 13, 14 and 16 to determine which, if any, are available for use. Alternatively, the user may wish to determine the entire status of any particular copying machine 12, 13, 14 or 16. In order to accomplish this objective, the keyboard 26 is provided with a number of keys (not shown) by means of which the user may indicate what parameters he wishes to display and for what copying machine(s).

Generally, only parameters (1) and (2) are of interest to copying machine users. Therefore, the display unit 17 may be adapted to be capable of displaying only these parameters, thus simplifying the design and reducing the size and cost of the display unit 17. It is desirable, however, to provide means by which maintenance and accounting personnel may have access to parameters (3) to (6), etc., in addition to the parameters (1) and (2).

In accordance with the advancement of electronic technology, it is becoming popular in the art of electrostatic copying to provide a computer such as a microcomputer to a copying machine which can optimally control the operation of the copying machine. Such computers control the exposure of a photoconductive drum in accordance with the density and contrast of an original document being copied, the amount of deterioration and/or fatigue of the drum, ambient temperature and humidity, etc. The computer may also perform other functions such as controlling the toner replenishment rate, etc. Since the functions which the computer performs are determined by the operating program stored in memory, new functions may be provided merely by adding additional software. In accordance with an important feature of the present invention, it is necessary to provide a computer to only one of the copying machines 12, 13, 14 and 16, for example the copying machine 12. The computer is designated as 31 and connected to monitor the parameters of and control all of the copying machines 12, 13, 14 and 16 through the bus lines 19, 21 and 22.

The computer 31 comprises a central processing unit (CPU) 32 which is connected to the bus lines 19, 21 and 22 through line buffers 33, 34 and 36 respectively. A memory 37 is provided for the CPU 32 which comprises a read-only memory (ROM) 38 for storing the operating program. A non-volatile random access memory (RAM) 39 is provided to store the parameters for all of the copying machines 12, 13, 14 and 16 in addition to other data for exposure control, intermediate results, etc. A control unit 41 is provided to enable the RAM 39 for read-write operations when power is available and to render the RAM 39 non-volatile when power is turned off. Further provided to the copying machine 12 are a control panel 42 and a printer 43 which are connected to the CPU 32 through an input-output interface 44.

Depression of suitable keys (not shown) on any of the keyboards 26 causes data signals to be fed to the computer 31 for display of the required parameters (1) and- /or (2) on the respective display 28. The control panel 42 comprises keys, switches or the like (not shown) which maintenance or accounting personnel may operate to cause the desired parameters (3) to (6) to be printed by the printer 43.

Referring now to FIG. 4, the copying machine 12 comprises a photoconductive drum 46 which is rotated clockwise at constant speed. An original document 47 is placed face down on a transparent glass platen 48 and illuminated by a light source 49. A light image of a linear portion of the document 47 is reflected by plane mirrors 51 and 52 to a lens 53 which has a reflecting rear surface. The light image is converged twice by the lens 53 and reflected via another plane mirror 54 onto the drum 46. The mirror 51 is moved relative to the document 47 at the same surface speed as the drum 46 for scanning the document 47. The mirror 52 is moved along with the mirror 51 but at one-half the surface speed of the drum 46.

Prior to imaging of the drum 46 a charger 56 applies a uniform electrostatic charge to the drum 46. The light image causes the formation of an electrostatic image through localized photoconduction. A developing unit 57 applies toner to the drum 46 to produce a toner image. A feed roller 58 feeds the top copy sheet 59 from a stack into engagement with the drum 46. A transfer charger 61 applies an electrostatic charge to the back of the copy sheet 59 to transfer the toner image thereto. Fixing rollers 62 fix the toner image to the copy sheet 59 and feed rollers 63 feed the finished copy into a discharge tray 64.

In accordance with the present invention the printer 43 may be a separate thermal, impact printer or the like. However, it is preferable to partially embody the printer 43 using various components of the copying machine 12. Illustrated in FIG. 4 is an imaging unit 66 disposed adjacent to the drum 46 upstream of the developing unit 57. The imaging unit 66 comprises a liquid crystal overlay 67 which is connected to the unit 44. The overlay 67 is normally transparent but becomes locally opaque in response to applied electrical signals from the computer 31. The overlay 67 is designed so that the opaque areas form characters corresponding to the status parameters of the copying machines 12, 13, 14 and 16.

The imaging unit 66 further comprises a strobe light 68 such as an xenon tube which produces a brief but intense flash of light. Condensors 69 make the light from the light 68 parallel for transmission through the overlay 67.

To produce a hard copy of the status parameters for maintenance or accounting, the corresponding keys on the control panel 42 are depressed and the computer 31 disables the ordinary scan operation of the copying machine 12. Signals are fed to the imaging unit 66 to form the corresponding pattern on the overlay 67. Then, the strobe light 68 is fired to radiate a light image of the pattern on the overlay 67 onto the drum 46. This causes the formation of an electrostatic image corresponding to the pattern in such a manner that the opaque areas of the pattern on the overlay 67 produce dark areas in the resulting toner image. The toner image is transferred to a copy sheet in the normal manner. If desired, the overlay 67 may only produce one line of data. In this case, lines of data are fed to the overlay 67 in a sequential manner and the strobe light 68 fired once for each line to sequentially produce electrostatic images of the lines of data.

Further illustrated in FIG. 4 are a discharge unit 71 for discharging the drum 46 prior to recharging and a cleaning unit 72 for removing residual toner from the drum 46.

It will be noted that since the strobe light 68 produces a very brief flash of light which is made parallel by the condensors 69, it is unnecessary to stop rotation of the drum 46 or dispose the imaging unit 66 extremely close to the drum 46.

In summary, it will be seen that the present invention provides an improved electrostatic copying apparatus comprising a number of inexpensive copying machines and means for electronically interconnecting the copying machines. A user at any of the copying machines can determine the status of any of the other copying machines. In addition, means are provided for optimally controlling all of the copying machines using a single computer and print out various maintenance and accounting data.

Various modifications will become possible for those skilled in the art after receiving the teachings of the present disclosure without departing from the scope thereof. For example, the display units 17 may be constituted by means such as a TMS 1967 Keyboard Interface unit manufactured by Texas Instruments Incorporated of Dallas, Texas USA. Such a device comprises a transparent electrode which is touched by the user's finger to input data. The device is actuated by a capacitance change resulting from proximity of the user's finger. It is also possible to eliminate the printer 43 and obtain soft copy of the maintenance and accounting data through the display device 17. It is also within the scope of the present invention to use as a parameter the type of copy the various copying machines are adapted to make; for example plain paper copies, diazo copies or masters for offset painting.

What is claimed is:

1. An electrostatic copying apparatus including a plurality of electrostatic copying machines and being characterized by comprising a plurality of sensor means connected to the copying machines respectively for sensing at least one copying machine status parameter, display means connected to the copying machines respectively and interconnection means for interconnecting all of the sensor means and display means in such a manner that each display means displays the status parameters of all of the copying machines.

2. An apparatus as in claim 1, in which the at least one status parameter comprises at least one of whether the respective copying machine is available for copying and a copy sheet size of the respective copying machine.

3. An apparatus as in claim 1, in which the at least one status parameter comprises at least one of a number of copies made by the respective copying machine, a number of remaining copy sheets and an amount of remaining toner.

4. An apparatus as in claim 1, in which the interconnection means comprises computing means provided in one of the copying machines and a bus line interconnecting the computing means with all of the sensor means and display means.

5. An apparatus as in claim 4, in which the computing means comprises a microcomputer.

6. An apparatus as in claim 4, further comprising printing means for printing the status parameters of all of the copying machines.

7. An apparatus as in claim 6, in which said one of the copying machines comprises a photoconductive member, the printing means comprising imaging means for radiating a light image corresponding to the status parameters onto the photoconductive member.

8. An apparatus as in claim 7, in which the imaging means comprises a liquid crystal overlay and a light source for radiating light through the overlay onto the photoconductive member.

9. An apparatus as in claim 8, in which the light source comprises a strobe.

10. An apparatus as in claim 1, in which each display means comprises a display unit and selector means for controlling the display unit to display only selected status parameters.

* * * * *